US010221725B2

(12) United States Patent
Martineau

(10) Patent No.: US 10,221,725 B2
(45) Date of Patent: Mar. 5, 2019

(54) STRAIN AUGMENTED THERMODYNAMIC POWER CYCLE

(71) Applicant: Phillip Reed Martineau, Salt Lake City, UT (US)

(72) Inventor: Phillip Reed Martineau, Salt Lake City, UT (US)

( * ) Notice: Subject to any disclaimer, the term of this patent is extended or adjusted under 35 U.S.C. 154(b) by 344 days.

(21) Appl. No.: 15/132,853

(22) Filed: Apr. 19, 2016

(65) Prior Publication Data

US 2017/0298781 A1 Oct. 19, 2017

(51) Int. Cl.

| | |
|---|---|
| ***F01K 23/10*** | (2006.01) |
| ***F01K 13/02*** | (2006.01) |
| ***F01K 25/08*** | (2006.01) |
| ***F01K 13/00*** | (2006.01) |
| ***F01K 27/00*** | (2006.01) |

(52) U.S. Cl.

CPC ..... *F01K 23/10* (2013.01); *F01K 13/00* (2013.01); *F01K 13/02* (2013.01); *F01K 25/08* (2013.01); *F01K 27/00* (2013.01)

(58) Field of Classification Search

CPC ..... F01K 23/10; F01K 27/00; F01K 13/00; F01K 13/02; F01K 25/08

See application file for complete search history.

(56) References Cited

U.S. PATENT DOCUMENTS

| | | | | |
|---|---|---|---|---|
| 6,530,224 | B1 * | 3/2003 | Conchieri | F01K 23/10 60/39.182 |
| 7,260,934 | B1 * | 8/2007 | Roberts | F01K 13/02 60/651 |
| 8,225,609 | B2 | 7/2012 | Hinderling | |
| 8,387,386 | B2 | 3/2013 | Schmeltz | |
| 8,640,462 | B2 * | 2/2014 | Shnell | F03G 7/04 60/641.2 |
| 8,674,525 | B2 | 3/2014 | Van Den Bossche | |
| 8,857,182 | B1 * | 10/2014 | Roper | F01K 25/08 290/1 R |
| 9,003,798 | B2 * | 4/2015 | Yanagi | F01K 23/10 60/651 |
| 9,021,808 | B2 | 5/2015 | Nelson | |
| 9,051,852 | B2 | 6/2015 | Geskes | |
| 9,115,603 | B2 | 8/2015 | Leibowitz | |
| 9,145,795 | B2 | 9/2015 | Lehar | |
| 9,206,710 | B2 * | 12/2015 | Gurin | F01K 23/10 |
| 9,457,313 | B2 * | 10/2016 | Baker | B01D 53/22 |
| 2011/0042968 | A1 * | 2/2011 | Tronstad | F01K 23/10 290/1 R |
| 2016/0040560 | A1 * | 2/2016 | Hariri | F01K 25/02 60/671 |
| 2017/0089222 | A1 * | 3/2017 | Wright, Jr. | F02G 5/02 |
| 2018/0051652 | A1 * | 2/2018 | Filippone | F02G 5/02 |

* cited by examiner

*Primary Examiner* — Michael C Zarroli

(57) ABSTRACT

Strain augmented power cycle is disclosed. This power cycle is a thermodynamic power cycle that contains a strain energy device to increase the thermodynamic efficiency above what is possible from a conventional Rankine power cycle. Strain augmented power cycle comprises an assembly of components including a working fluid, a pump, an evaporator, a strain energy device, an expander and a condenser.

10 Claims, 5 Drawing Sheets

STRAIN AUGMENTED THERMODYNAMIC POWER CYCLE

CROSS REFERENCE TO RELATED APPLICATIONS

None

BACKGROUND

Prior Art

The Following is a tabulation of prior art that appear to be relevant:

| U.S. Patents | | | |
|---|---|---|---|
| Pat. No. | Kind Code | Issue Date | Patentee |
| 9,206,710 | A | 2015 Dec. 8 | Gurin |
| 9,145,795 | A | 2015 Sep. 29 | Lehar |
| 9,115,603 | A | 2015 Aug. 25 | Leibowitz |
| 9,051,852 | A | 2015 Jun. 9 | Geskes |
| 9,021,808 | A | 2015 May 5 | Nelson |
| 9,003,798 | A | 2015 Apr. 14 | Yanagi |
| 8,674,525 | A | 2015 Mar. 18 | Van Den Bossche |
| 8,387,386 | A | 2015 Mar. 18 | Schmeltz |
| 8,225,609 | A | 2015 Jul. 24 | Hinderling |

| Foreign Patent Documents | | | |
|---|---|---|---|
| Publication Doc. Nr. | Cntry Code | Bubl. Date | Applicant |
| 176812 | WO | November 2015 | KOLLMEIER |

Non Patent Literature Documents

Thermodynamic power cycles are used to convert thermal energy into mechanical energy. In a power cycle, a working fluid flows through a series of thermodynamic processes to achieve this energy conversion. An example of this type of cycle is a prior art Rankine cycle. In a prior art Rankine cycle, a typical working fluid is water.

The thermodynamic state of a working fluid can be described by specifying a set of thermodynamic properties. Two properties are needed to defined the state of a working fluid. If two properties are known, the state of the working fluid is defined and as a result, all of the remaining properties are known. Examples of thermodynamic properties include: temperature, pressure, mass density, internal energy, enthalpy, and entropy.

A working fluid can exist in one of the following phases: solid, liquid or vapor. In the liquid phase, a working fluid can exist as a saturated liquid or compressed liquid. In the vapor phase, the working fluid can exist as a saturated vapor or superheated vapor. If a working fluid is a saturated fluid, the fluid can exist as a solid, liquid or vapor. In addition, the working fluid can simultaneously exist as a saturated solid and liquid, a saturated liquid and vapor, and a saturated solid, liquid and vapor. If a saturated fluid is at a given temperature, the saturation pressure is known and as a result, the remaining thermodynamic properties are known.

Prior Art Rankine Cycle FIG. 1A and FIG. 1B

FIG. 1A shows an example of a prior art Rankine cycle 500, wherein a representative thermodynamic cycle is described. At the beginning of the cycle, the working fluid starts as a saturated liquid 10. The working fluid is then pressurized to high pressure compressed liquid 12 by pump

30. Input work 120 is the work required from pump 30 to increase the pressure from saturated liquid 10 pressure to compressed liquid 12 pressure. After leaving pump 30, compressed liquid 12 enters evaporator 40. High temperature input thermal energy 100 enters evaporator 40 and is transferred to compressed liquid 12 to produce high pressure and temperature vapor 14. The vaporization process from compressed liquid 12 to high temperature and pressure vapor 14 is a constant pressure process. In other words, compressed liquid 12 and superheated vapor 14 exist at the same pressure. High pressure and temperature superheated vapor 14 exits evaporator 40 and flows into expander 50. Expander 50 may be a positive displacement machine of various configurations, including but not limited to a screw expander or a turbine. In expander 50, high pressure and temperature vapor 14 expands to low pressure and temperature saturated vapor 16 at the exit of expander 50. This expansion produces output work 200 in the form of rotational kinetic energy that is operatively coupled to drive an electrical generator to produce electrical power. The electrical power may be delivered to a local isolated power grid or a commercial power grid. Energy that is transferred from saturated vapor 16 and saturated liquid 10, while transiting condenser 60, is waste thermal energy 150 and is expelled to the environment by condenser 60. The transfer of waste thermal energy 150 from the working fluid results in condensation of saturated vapor 16 back to saturated liquid 10. Waste thermal energy 150 can also be described as the working fluid's latent heat of condensation. Saturated liquid 10 then flows from condenser 60 and reenters pump 30 to repeat the cycle.

A sufficient temperature difference between the working fluid and environment is required for waste thermal energy 150 to be expelled to the environment. This means that the working fluid saturation temperature is substantially determined by the environmental temperature. For a saturated vapor, definition of the saturation temperature is sufficient to determine the remaining thermodynamic properties including pressure, mass density, enthalpy, internal energy and entropy.

The expansion of high temperature and pressure vapor 14 to saturated vapor 16 in expander 50 is substantially a constant entropy adiabatic expansion process. As a result, the entropy of saturated vapor 16 is substantially the same as the entropy of high temperature and pressure vapor 14. In addition, the temperature of high temperature and pressure vapor 14 is determined by the temperature of input thermal energy 100. This means the pressure of high temperature and pressure vapor 14 is determined by the entropy of saturated vapor 16 and the temperature of input thermal energy 100.

FIG. 1B shows a temperature vs. entropy diagram for prior art Rankine cycle 500. Saturation dome 20 is comprised of critical point 21, saturated liquid transition 22, and saturated vapor transition 25. Saturated liquid transition 22 represents the transition from compressed liquid region 24 to saturated fluid region 25. Any temperature and entropy coordinate that falls on saturated liquid transition 22 represents a working fluid that is in a saturated liquid state. Saturated fluid region 25 represents temperature and entropy values where saturated liquid and saturated vapor can coexist. Saturated vapor transition 26 represents the transition from saturated fluid region 25 to superheated vapor region 28. Any temperature and entropy coordinate that falls on saturated vapor transition 26 represents a working fluid that is in a saturated vapor state. Critical point 21 represents where saturated liquid transition 22 and saturated vapor transition 26 meet. The working fluid at any temperature above critical point 21 is a superheated fluid. As FIG. 1B shows, saturated liquid 10 falls on saturated liquid transition 22, compressed liquid 12 is positioned within compressed liquid region 24, high temperature and pressure vapor 14 is positioned within superheated vapor region 28, and saturated vapor 16 falls on saturated vapor transition 26.

Constant entropy process 55 represents the adiabatic process of expanding high temperature and pressure vapor 14 to saturated vapor 16. Because of constant entropy process 55 the minimum and maximum temperature limits for prior art Rankine cycle 500 are control by the saturation conditions of saturated vapor 16. The minimum temperature limit and the entropy are determined by the temperature of saturated vapor 16. The saturation temperature is determined by the temperature of the environment to which waste thermal energy 150 can be expelled. The entropy of constant entropy process 55 is the entropy of saturated vapor 16 at the saturation temperature. The maximum temperature limit of high temperature and pressure vapor 14 is determined by the temperature limit of input thermal energy 100. With the temperature of input thermal energy 100 and saturated vapor 16 entropy, the remaining thermodynamic properties of high temperature and pressure vapor 14 can be determined including pressure and enthalpy.

The vaporization of compressed liquid 12 to high pressure and temperature vapor 14 is represented by constant pressure process 45. As the temperature of compressed liquid 12 increases, the pressure remains constant. Vaporization of the working fluid between saturation liquid transition 22 and saturated vapor transition 26 is a constant temperature and pressure process. As the temperature of the working fluid increases to high temperature and pressure vapor 14, the pressure also remains constant. As a result, constant pressure process 45 extends from compressed liquid 12 to high temperature and pressure vapor 14. This means that entropy of constant entropy process 55 and the temperature of high temperature and pressure vapor 14 determine the pressure of constant pressure process 45.

The condensation of saturated vapor 16 to saturated liquid 10 is a constant pressure and temperature process that is represented by condensation process 65. Condensation process 65 extents from saturated vapor 16 to saturated liquid 10. The temperature and pressure of condensation process 65 are the saturation pressure and temperature of the working fluid.

In an alternate embodiment of strain augmented power cycle 600, the constant entropy process could intersect the condensation process inside the saturated fluid region. An example of this alternate process is represented by alternate constant entropy process 56. In this process, alternate constant entropy process 56 crosses saturated vapor transition 26 and intersects condensation process 65 inside saturated fluid region 25.

Output work 200 can be calculated from the difference between the enthalpy of superheated vapor 14 and the enthalpy of saturated vapor 16. The input thermal energy 100 can be calculated by the difference between the enthalpy of superheated vapor 14 and the enthalpy of compressed liquid 12. The enthalpy of compressed liquid can be calculated by adding input work 120 to the enthalpy of saturated liquid 10.

The efficiency of any thermodynamic power cycle, including the Rankine cycle, can be described by the ratio of the total work output divided by the input thermal energy. In addition, the waste heat ratio can be described by the ratio of waste heat expelled divided by the input thermal energy.

For prior art Rankine cycle 500, the total output work is the difference between output work 200 and input work 120. However, input work 120 is much smaller than output work 200 and as a result, can be neglected. This means the total work can be closely approximated by output work 200. As a result, the efficiency for prior art Rankine cycle 500 the efficiency can be closely approximated by the ratio of output work 200 divided by input thermal energy 100. And, the waste heat ratio is waste thermal energy 150 divided by input thermal energy 100. The sum of the efficiency and the waste heat ratio is substantially one. For prior art Rankine cycle 500 with a high temperature source for input thermal energy 100, thermodynamic efficiencies can range from 0.3 to 0.4; with corresponding waste heat ratios ranging from 0.7 to 0.6. For low temperature energy sources, such as geothermal and solar thermal, the resulting thermodynamic efficiencies for prior art Rankine cycle 500 are less than 0.12; with corresponding waste heat ratios of greater than 0.88. This shows that the higher the temperature of input thermal energy 100 the greater the thermodynamic efficiency. This is because a larger portion of input thermal energy 100 is converted to output work 200 and a smaller portion of the energy is expelled as waste energy 150.

A Carnot cycle is an ideal power cycle that has the highest possible theoretical thermodynamic efficiency. In a Carnot cycle, heat is exchanged between a high temperature reservoir and a working fluid and heat is exchanged between a low temperature reservoir and a working fluid to produce work. The thermodynamic efficiency of a Carnot ηc cycle is described as $$\eta c = 1 - \frac{Tl}{Th}$$

where TI is the absolute temperature of the low temperature reservoir and Th is the absolute temperature of the high temperature reservoir. Even though prior art Rankine cycle 500 efficiency is less that the Carnot cycle efficiency, a comparison between the Carnot cycle efficiency and prior art Rankine cycle 500 efficiency for identical temperature limits show the same type of relationship between the temperatures and cycle efficiencies. For example, a representative high temperature source for input thermal energy source 100 is 773° K and a representative temperature for saturated vapor 16 is 333° K. The temperature input thermal energy 100 corresponds to the high temperature reservoir and the temperature of saturated vapor 16 corresponds to the low temperature reservoir. Substituting these temperatures into the Carnot cycle efficiency equation produces an efficiency of 0.56. For representative low temperature sources for input thermal energy 100 is 523° K. If saturated vapor temperature 16 remains the same, the Carnot cycle efficiency is 0.36.

A means to increase the efficiency of a thermodynamic power cycle including a Rankine cycle would be beneficial. Prior art methods for increasing efficiencies rely on recovery of the waste heat from a primary, "top", power cycle as input thermal energy to a, "bottom", power cycle, as disclosed in U.S. Pat. Nos. 9,206,710, 9,145,795, 9,115,603, 9,051,852, 9,021,808 and 9,003,798. The working fluid for these low temperature power cycles is typically a low vaporization temperature organic fluid. The thermodynamic efficiencies of these, "bottom", power cycles are subject to the same limitation as that of the, "top", power cycles. That is, a larger portion of the energy is expelled as waste heat. In addition, because of their low temperatures, the bottom cycle thermodynamic efficiencies are limited to approximately 12 %. As a result, the overall efficiency gains made possible by additions of bottom power cycles are limited to small fractions of the input thermal energy. This means that small thermodynamic efficiency increases can be achieved through the recovery of the heat of condensation.

A means to increase the input thermal energy without increasing the waste heat would increase the thermodynamic efficiency of the power cycle. This approach for increasing the thermodynamic efficiency would be beneficial.

SUMMARY

In accordance with one embodiment of a strain augmented power cycle, a strain energy device provides a means to increase the energy for available for conversion to work. The strain energy device is comprised of a cavity that is formed by a thick wall of elastomeric material. In addition, the strain energy device has at least one flow valve. The flow valve controls flow of a working fluid into and out of the device. This elastomeric material can sustain strains that range in magnitude from a few percent to as much as several hundred percent. The strain energy device increases the input thermal energy of the strain augmented power cycle by inflating the strain energy device. The energy flow into the strain energy device during inflation of the device is substantially the same as the energy flow from the device during deflation.

When the flow valve is in an opened position, high temperature and pressure vapor working fluid inflates the strain energy device from an uninflated state to an inflated state. This inflation strains and imparts strain energy in the walls of the strain energy device. The energy flow into the strain energy device includes the enthalpy contained within the volume of working fluid plus the strain energy imposed by stretching the walls of the strain energy device. After the strain energy device is inflated and the flow valve is closed, the energy contained within the strain energy device is the sum of the enthalpy of the working fluid plus the strain energy contained within the elastomeric walls. When the valve is opened, the stain energy device deflates. The energy flow out of the strain energy device from deflation is substantially the same as the inflation energy flow into the strain energy device.

Placement of a strain energy device between an evaporator and an expander of a thermodynamic power cycle provides a means to increase the energy available for conversion to work in the expander. In a prior art power cycle, the energy available for conversion into work is only the portion of the high temperature and pressure vapor energy that does not include the latent heat of condensation. In a strain augmented power cycle, the energy available for conversion into work is the sum of the strain energy plus the same portion of the energy that does not include the latent heat of condensation.

An example of a one embodiment of a strain augmented power cycle comprises:

1. A working fluid that is pressurized from a low pressure and temperature to a high-pressure compressed liquid, followed by;
2. A constant pressure heat addition wherein the heat addition produces a high temperature and pressure vapor, followed by;
3. A constant pressure Inflation of a strain energy device from an uninflated state to an inflated state by flow of the high temperature and pressure vapor into the strain energy device wherein the inflation imparts strain energy in the walls of the strain energy device, followed by;
4. A constant entropy deflation process wherein enthalpy and strain energy exits the strain energy device and flows into an expander, followed by;
5. A constant entropy expansion of the working fluid, in an expander, from a high temperature and pressure vapor to a saturated vapor wherein the expander produces work, followed by;
6. A constant temperature and pressure condensation of the working fluid from a saturated vapor to a saturated liquid, wherein the heat of condensation is transferred from the working fluid to the environment by the condenser, followed by;
7. Flow of the saturated liquid working fluid into a pump where the saturated liquid is pressurized to a high-pressure compressed liquid wherein the working fluid repeats the cycle.

In the above example, a pump and the high temperature input thermal energy produces the flow of high temperature and pressure vapor into the inflated strain energy device. The latent heat of condensation is the waste heat. The portion of work produced from the flow of high temperature and pressure vapor, through the expander, is the component of work that is produced from thermal energy. The portion of the work produced from strain energy device induced flow is the component of work produced from strain energy. The strain energy is substantially reversible. This means that the inflation strain energy is substantially equal to the deflation strain energy. As a result, the strain energy is substantially equivalent to the work produced from strain energy induced flow.

As described above, the efficiency of a power cycle is defined as the work output divided by the input thermal energy. Based on this definition of efficiency, the efficiency for a strain augmented power cycle is greater than the efficiency of a prior art Rankine cycle. The reason for this higher efficiency is described in the following comparison between a prior art Rankine cycle and a strain power augmented cycle. In this comparison, one unit of working fluid mass cycles through a Rankine cycle and one unit of working fluid mass cycles through a strain augmented power cycle. In both cycles, the working fluid is vaporized to identical high temperature and pressure vapor states. In addition, the working fluid is expanded through expanders to the same saturated vapor states.

In a prior art Rankine cycle, the input energy is only the energy that changes the enthalpy of the working fluid. The output work is comprised of the work only produced from the input thermal energy. In addition, the latent heat of condensation is the waste heat. The cycle efficiency is then the work produced from thermal energy divided by the input energy. The waste heat ratio is the waste heat divided by the input thermal energy. The sum of the cycle efficiency and the waste heat ratio is equal to one.

For the strain augmented power cycle, the input energy is the sum of the energy to change the enthalpy (i.e. input thermal energy) plus the strain energy. The produced work is the sum of the work produced from thermal energy plus the work produced from strain energy. Therefore, the cycle efficiency is the sum of the work produced from thermal energy plus the work produced from strain energy divided by the input energy. The waste heat ratio is the waste heat divided by the input energy.

The waste heat for the prior art Rankine cycle is the same as the waste heat for the strain augmented power cycle. This is because the mass of the working fluid is the same for both cycles and is heated to identical high temperature and pressure vapor states. As a result, the waste heat ratio for a strain augmented power cycle is less than the waste heat ratio for a prior art Rankine cycle. This means the strain augmented power cycle efficiency is greater than the efficiency of prior art the Rankine cycle.

A strain energy device of the strain augmented power cycle comprises a cavity formed by thick walls of an elastomeric material wherein the elastomeric material is capable of sustaining large strains. In addition, the strain energy device has at least one valve that regulates the flow of working fluid into and out of the cavity. The valve has the ability to prevent flow from entering or leaving the device. The valve also has the ability to allow the flow to completely inflate or deflate the strain energy device over a short period.

In another embodiment, the strain energy device has more than one valve. At least one of the valves allows flow into the strain energy device and at least one of a different valve allows flow out of the device.

In another embodiment of the strain augmented power cycle, the strain energy device comprises a cylindrical cavity formed by a thick walled cylindrical elastomeric tube and wherein a disk is affixed to each end of the elastomeric tube. At least one of the disks functions as a port that regulates flow into and out of the device.

In yet another embodiment of an elastomeric strain energy device, a spherical cavity is formed by a thick walled spherical shell with a single opening wherein a port is affixed to the spherical shell at the single opening. The port has two flow regulation features. One of the flow regulation feature regulates flow into the strain energy device and the other regulation feature regulates flow from the strain energy device.

In yet another embodiment a coupling fluid provides a pressure connection between the high temperature and pressure vapor and the strain energy device wherein, the coupling fluid inflates the strain energy device. When the working fluid is pressurized, the coupling fluid is forced into and inflates the strain energy device. The coupling fluid is forced from the strain energy device during deflation of the strain energy device.

ADVANTAGES

Accordingly, several advantages of one or more aspects for strain augmented strain energy devices are as follows: to increase the efficiency of a closed power cycle by imparting strain energy into a strain energy device; to recover substantially all of the strain energy in the form of flow energy; to produce usable work from the flow of strain and thermal energy through an expander. Other advantages of one or more aspects will be apparent from a consideration of the drawings and ensuing description.

DRAWINGS-FIGURES

Figure 1A:
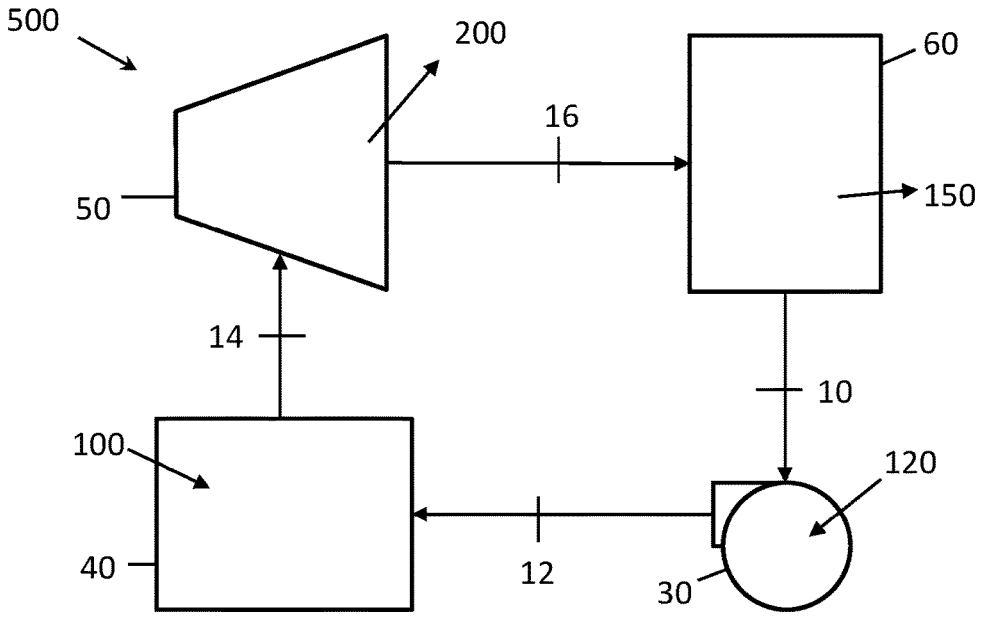
FIG. 1A Prior Art
FIGS. 1A and 1B shows various aspects of a prior art Rankine cycle.

| Drawings-Reference Numerals | | | |
|---|---|---|---|
| 10 | saturated liquid | 12 | compressed liquid |
| 14 | High temperature and pressure vapor | 16 | saturated vapor |
| 20 | saturation dome | 21 | critical point |
| 22 | saturated liquid transition | 24 | compressed liquid region |
| 25 | saturated fluid region | 26 | saturated vapor transition |
| 28 | superheated vapor region | 30 | Pump |
| 35 | pumping process | 40 | evaporator |
| 45 | constant pressure process | 50 | expander |
| 55 | constant entropy process | 56 | alternate constant entropy process |
| 60 | Condenser | 65 | condensation process |
| 70 | inlet valve | 72 | exit valve |
| 74 | Cavity | 75 | strain energy device |
| 77 | elastomeric walls | 100 | input thermal energy |
| 120 | input work | 150 | waste thermal energy |
| 200 | output work | 310 | evaporator control volume |
| 320 | expander control volume | 330 | condenser control volume |
| 340 | pump control volume | 500 | prior art Rankine cycle |
| 600 | strain augmented power cycle | | |

DETAILED DESCRIPTION OF THE PREFERRED EMBODIMENTS

The following provides a detailed description of the present invention with respect to a few preferred embodiments. This description provides a thorough understanding of the present invention through discussion of specific details of these preferred embodiments. To those skilled in the current art, it will be apparent that the present invention can be practiced with variations to the preferred embodiments, with or without some or all of these specific details. Well known processes, steps, and/or elements have not been described in order to focus on, and not obscure, those elements of the present invention.

Figure 2A:
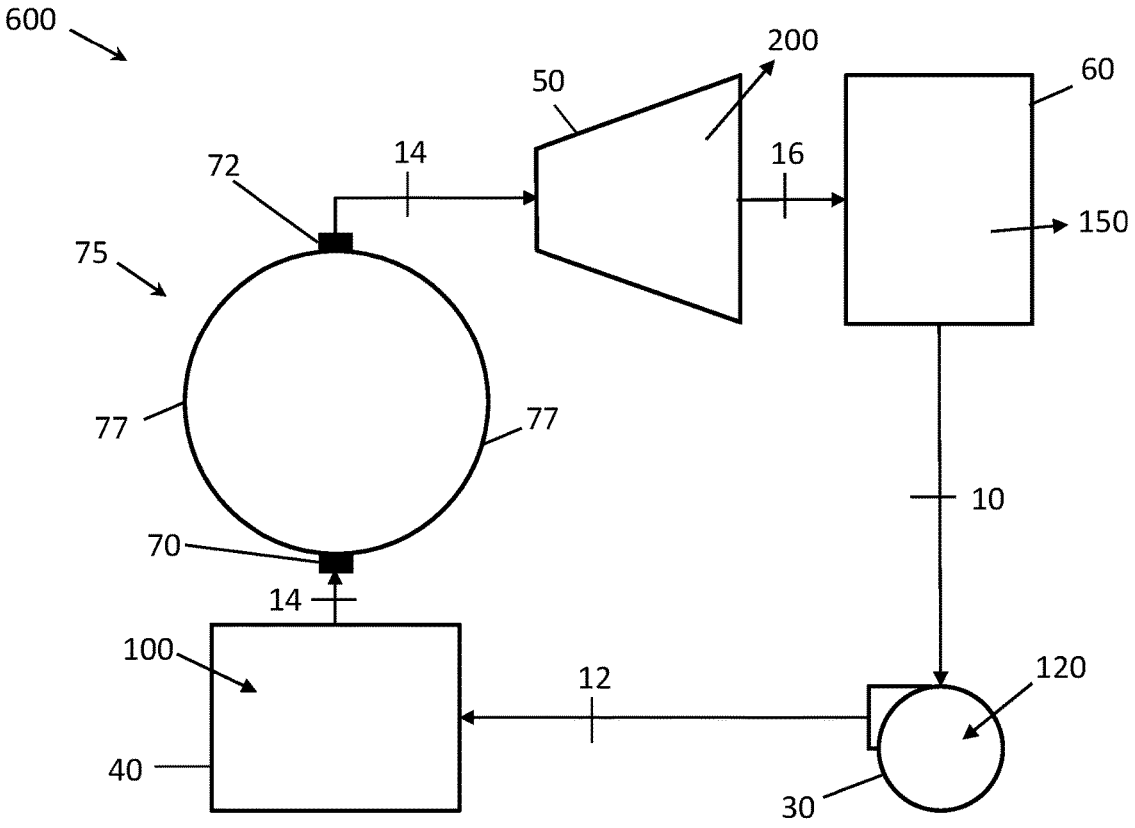
FIGS. 2A to 2C shows various aspects of a strain augmented power cycle.
Figure 2B:
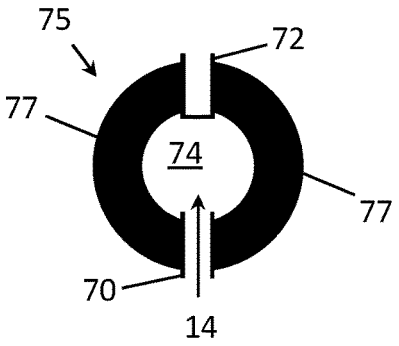
Figure 2C:
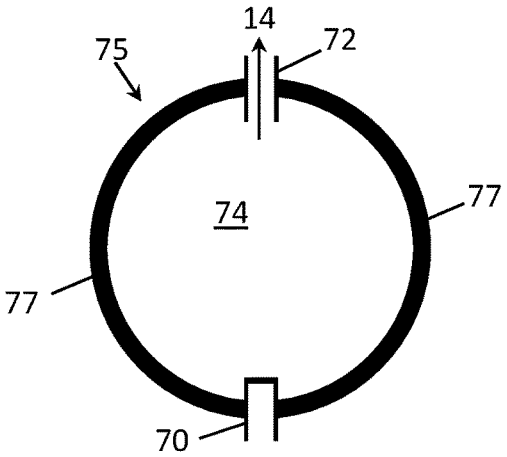

Strain Augmented Power Cycle FIG. 2A, FIG. 2B and FIG. 2C

FIG. 2A shows a preferred embodiment of a strain augmented power cycle 600. At the beginning of the cycle, the working fluid starts as a saturated liquid 10. Pump 30 then pressurizes saturated liquid 10 to a high-pressure compressed liquid 12 by input work 120. pump 30 constitutes a means for pressuring saturated liquid 10 to high-pressure compressed liquid 12. After leaving pump 30, compressed liquid 12 enters evaporator 40. High temperature input thermal energy 100 enters evaporator 40 and is transfers to compressed liquid 12 to produce high temperature and pressure vapor 14 at constant pressure. Saturated liquid 10, high-pressure compressed liquid 12 and high temperature compressed liquid 12 constitute a working fluid means. High temperature input thermal energy 100 constitutes a source of heat energy means. Evaporator 40 constitutes a working fluid heat exchanger means, High temperature and pressure vapor 14 constitute a high temperature and pressure vapor means. Compressed liquid 12, and high temperature and pressure vapor 14 exist at the same high pressure. High pressure and temperature vapor 14 exits evaporator 40, and flows into and inflates strain energy device 75. Strain energy device 75 constitutes a working fluid strain energy device means. No additional heat or energy is transferred to or from high temperature and pressure vapor 14 during inflation of strain energy device 75. Strain energy device 75 is comprised of elastomeric walls 77, inlet valve 70 and exit valve 72. Elastomeric walls 77 constitute elastomeric wall means. FIG. 2B shows a cross section of strain energy device 75 in an uninflated condition with inlet valve 70 in an open position and exit valve 72 in closed position. High temperature and pressure vapor 14 flows through inlet valve 70 into cavity 74 of strain energy device 75. Cavity 74 constitutes working fluid cavity means. As high temperature and pressure vapor 14 flows into cavity 74 of strain energy device 75, elastomeric walls 77 stretch until strain energy device reaches an inflated condition. In the inflated condition, the energy contained within strain energy device 75 is the sum of the total enthalpy contained within cavity 74 plus the strain energy contained within elastomeric walls 77. When strain energy device 75 reaches the inflated condition, inlet valve 70 switches to a closed position and exit valve switches to an open position. FIG. 2C shows a cross section of strain energy device 75 in an inflated condition with inlet valve 70 in a closed position and exit valve 72 in an open position. High pressure and temperature working fluid 14 flows from cavity 74 of strain energy device 75 until strain energy device 75 returns to the uninflated condition. During deflation of strain energy device 75, the strain energy contained within elastomeric walls 77 transfers to high pressure and temperature working fluid 14. The total energy flow from strain energy device 75 during deflation is the sum of the strain energy in elastomeric walls 77 plus the total enthalpy of high temperature and pressure vapor 14.

Elastomeric walls 77 of uninflated strain energy device 75, as shown in FIG. 2B, are much thicker than the walls 77 of inflated strain energy device 75 as show FIG. 2C. This is because the elastomeric material is incompressible and as result, the elastomeric material does not change in volume. The volume of inflated cavity 74 is much larger than uninflated cavity 74. As a result, elastomeric walls 77 must stretch in order to enclose inflated cavity 74. This means that the stretched elastomeric walls 77 must be much thinner than the walls 77 of an uninflated strain energy device 75.

For a hollow sphere, the distance from the center to the inside surface (i.e. inside radius) of the sphere is I and the distance from the center to the outside surface (i.e. outside radius) of the sphere is O. The ratio of the O divided by I is equal to φ described below as $$\varphi = \frac{0}{I}$$

where φ is the ratio of O divided by I. The volume of the hollow sphere is described below as $$V = \frac{4}{3}\pi I^3(\varphi^3 - 1)$$

where V is the volume of the hollow sphere wall. If strain energy device 75 is spherically shaped then the volume of elastomeric walls 77 can be described by the above expression for the volume of a hollow sphere.

The work required to inflate strain energy device can be described as $$WI = \int_0^V PdV$$

where WI is the work to inflate strain energy device 75, P is the pressure in cavity 74, V is the volume of cavity 74 and dV is the differential volume. Because inflation of strain energy device 75 is a constant pressure process, the WI can be describe as $$WI=PV.$$

Because the inflation process occurs over a short period of time, there is no heat transfer into elastomeric walls 77. As a result, the inflation work and the strain energy are equivalent as described below $$S=PV$$

where S is the strain energy contained within elastomeric walls 77 of strain energy device 75.

The strain energy for a thick-walled hollow elastomeric sphere can be described below as $$S = 1.6875\frac{P^2V}{E}\frac{\varphi^3}{(\varphi^3 - 1)}$$

where E is the elastic modulus of the elastomeric materials in elastomeric walls 77. Combining the two expressions for S and rearranging results in an expression for φ described below as $$\varphi = \sqrt[3]{\frac{1}{\left(1 - 1.6875\frac{P}{E}\right)}}$$

Figure 1B:
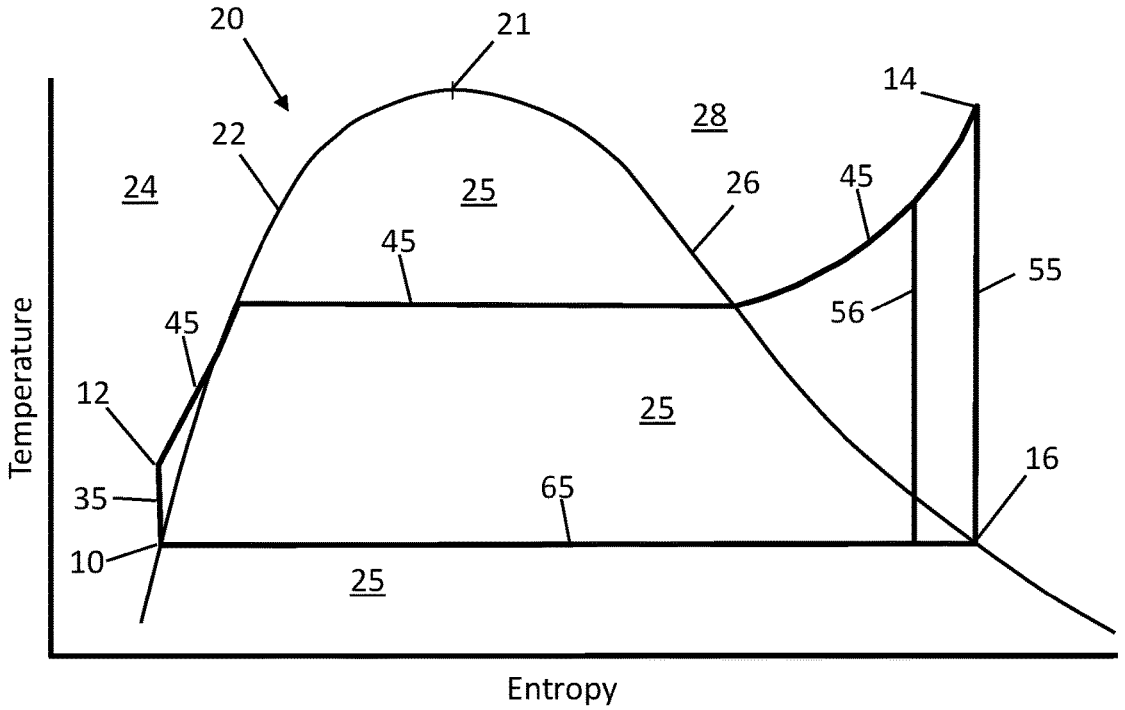
FIG. 1B Prior Art

With the above equation for φ and representative values for the system pressure "P" and the elastic modulus "E" of elastomeric walls 77 a representative value of φ can be shown. As can be seen in FIG. 1B, once the entropy of saturated vapor is determined, and the temperature of input thermal energy 100 is known, the pressure of input thermal energy can be determined. A representative working fluid for Rankine cycle 500 and strain augmented power cycle 600 is water. A representative saturation temperature for water that is used in Rankine cycle 500 and strain augmented power cycle 600 is 39° C. This representative temperature allows the heat transfer of waste thermal energy 150 into the environment by condenser 60. At 39° C., the saturated vapor entropy for water is 8.275 kJ/kg° K. A representative temperature for high temperature vapor 14 is 400° C. The corresponding pressure for a superheated water vapor at 400° C. is P=0.178 MPa. A possible material for elastomeric walls 77 is an unfilled silicone rubber with an elastic modulus of E=1.2 MPa. Substituting the values for P and E into the expression for φ results in φ=1.10. This means that the thickness of elastomeric walls 77 is 10% of the inside radius of strain energy device 75 if strain energy device 75 was spherically shaped. In other words, strain energy device 75 requires elastomeric walls 77 that are at least 10% of "I" in thickness in order to produce optimum strain energy.

As strain energy device 75 deflates, high pressure and temperature vapor 14 flows into expander 50. Expander 50 constitutes a working fluid expander means. The total energy flow into expander 50 is the sum of the strain energy plus the total enthalpy of high temperature and pressure vapor 14. The total energy that leaves the expander 50 is output work 200 plus the total enthalpy of saturated vapor working fluid 16. Saturated vapor 16 exits expander 50 and flows into condenser 60. Condenser 60 converts saturated vapor 16 to saturated liquid 10. The difference in total enthalpy between saturated vapor 16 and saturated liquid 10 is the energy rejected to the environment as waste thermal energy 150. Saturated vapor 16 working fluid flows from condenser 60 and into pump 30 to repeat the cycle.

Inflation and deflation of strain energy device 75 occurs quickly enough so that no heat transferred occurs into or out of elastomeric walls 77. In addition, the volume of elastomeric walls 77 does not change during inflation and deflation. No additional heat is added to high temperature and pressure vapor 14 during inflation of strain energy device 75, after leaving evaporator 40. The definition of a constant entropy process is one where there is no energy transferred into or out of a system and the volume of the system does not change. This means inflation and deflation of strain energy device 75 is a constant entropy processes.

Energy and Work Flow Control Volumes FIG. 3A through FIG. 5B

Figure 3A:
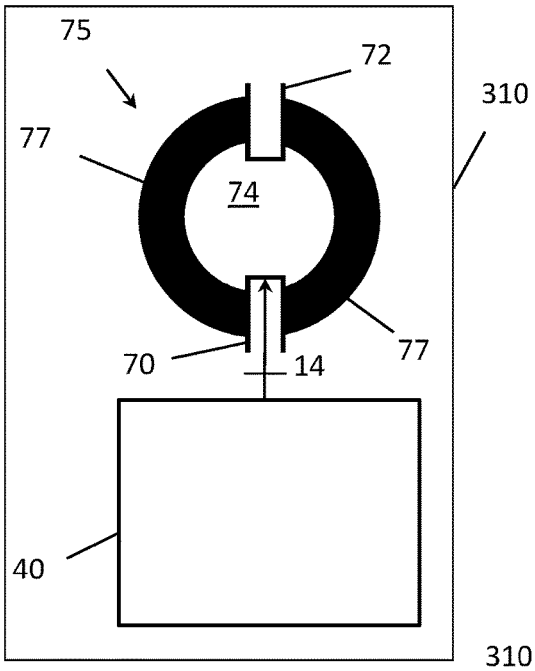
FIGS. 3A and 3B shows various aspects of a control volume that surrounds the strain energy device and the evaporator of a strain augmented power cycle.

FIG. 3A shows evaporator control volume 310 surrounding evaporator 40 and strain energy device 75 in the uninflated condition. A control volume is an imaginary boundary that contains energy, working fluid and the relevant system components. In addition, energy and work can flow across the boundary. At an initial time, fluid flow, or energy is not crossing evaporator control volume 310. High temperature and pressure vapor 14 is blocked from flowing into strain energy device 75 by closed inlet valve 70. At the initial time, the strain energy in elastomeric walls 77 and the thermal energy in cavity 74 are set at zero.

Figure 3B:
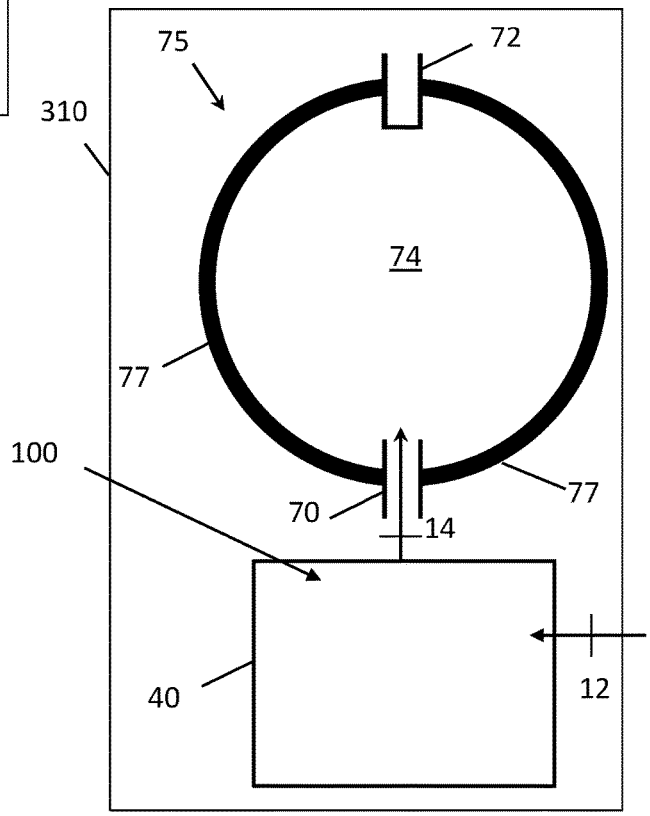

FIG. 3B shows evaporator control volume 310, at a later time, when inlet valve 70 is in an open position and exit valve 72 is in a closed position. High temperature and pressure vapor 14 flows from evaporator 40 and inflates strain energy device 75. Strain augmented power cycle 600 input thermal energy 100 is the input energy that flows through evaporator 40 as described below $$Q40=Q75-H12$$

where Q40 is input thermal energy 100 into evaporator 40, Q75 is the energy contained in strain energy device 75 and H12 is the total enthalpy of compressed liquid 12.

Figure 4A:
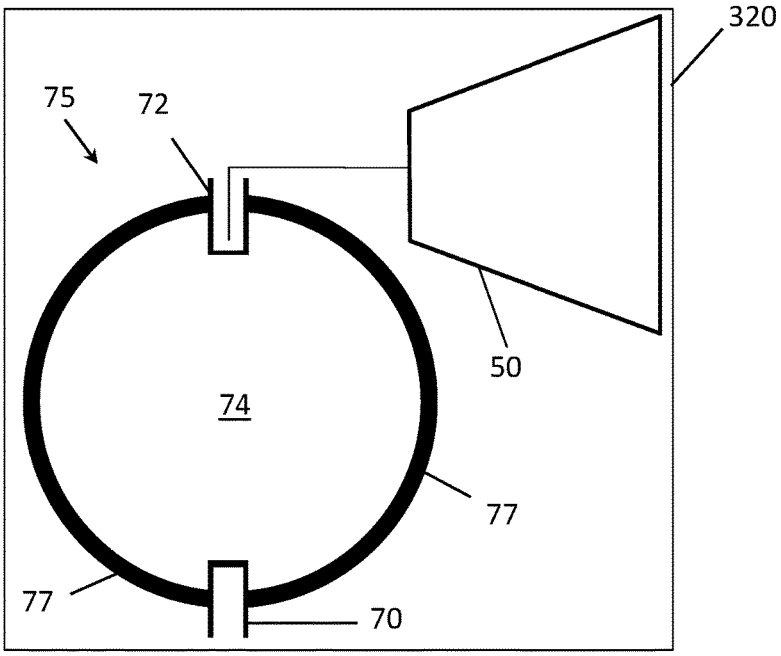
FIGS. 4A and 4B shows various aspects of a control volume that surrounds the strain energy device and expander of a strain augmented power cycle.

FIG. 4A shows expander control volume 320 that surrounds fully inflated strain energy device 75 and expander 50. There is no energy or work flowing into or out of control volume 320. Valves 70 and 72 are in their closed positions so that high temperature and pressure vapor 14 is retained in cavity 74. The total energy in inflated strain energy device 75 described below is $$Q75=H14+S$$

where H14 is the total enthalpy of high temperature and pressure vapor 14 contained in cavity 74, and S is the strain energy in elastomeric walls 77.

Figure 4B:
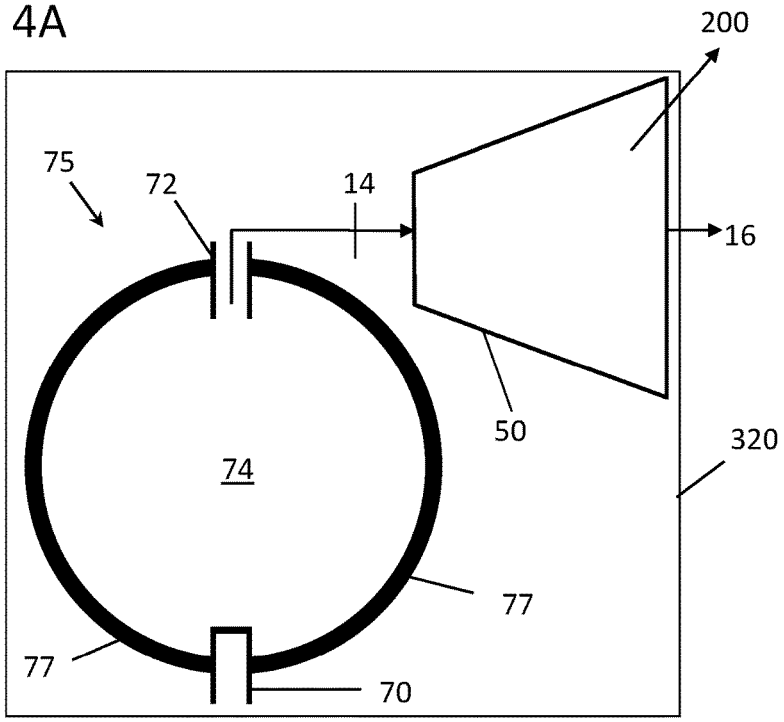

FIG. 4B shows expander control volume 320, at a later time, when exit valve 72 is in the open position and high temperature and pressure vapor 14 flows from strain energy device 75 into expander 50. The energy that exits control volume 320, during deflation of strain energy device 75, includes output work 200 and saturated vapor 16. The total output work 200 produced by expander 50 after strain energy device is fully deflated is describe below as $$WT=H14-H16+S$$

where WT is the output work 200 from expander 50 and H16 is the enthalpy of saturated vapor 16. The strain energy is substantially reversible and recovered by expander 50 during deflation of strain energy device 75.

Figure 5A:
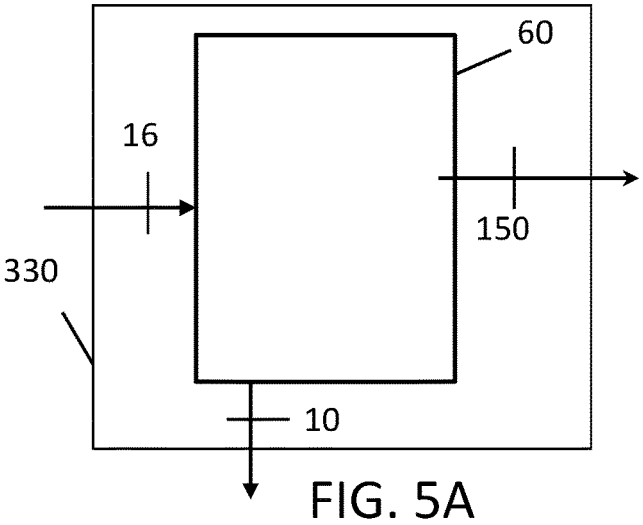
FIGS. 5A and 5B shows various aspects of control volumes that surrounds the condenser and the pump of a strain augmented power cycle.

FIG. 5A shows condenser control volume 330 that surrounds condenser 60 during flow of saturated working fluid 16 into condenser 60, and flow of saturated liquid 10 and waste heat 150 from condenser. Condenser 60 constitutes a working fluid condenser means and a means for transferring heat from saturated vapor 16. Waste heat 150 is the thermal energy that flows from condenser 60 described below as $$Q60=H16-H10$$

where Q60 is the waste thermal energy 150 and H10 is the enthalpy of saturated liquid 10.

Figure 5B:
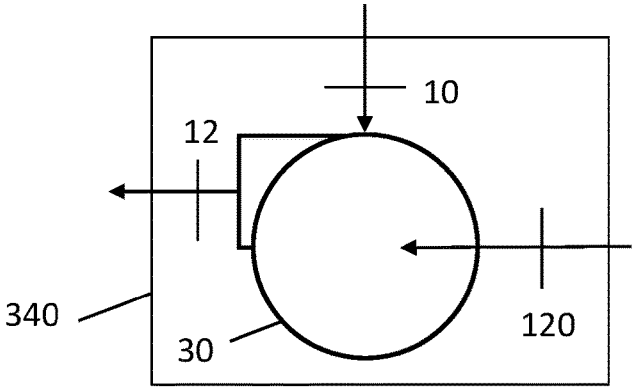

FIG. 5B shows pump control volume 340 that surround pump 30. Saturated liquid 10 and input work 120 flows into pump 30 and compressed liquid 12 flows out of pump 30. Input work 120 is the work required to pressurize saturated liquid 10 to compressed liquid 12 shown below as $$WP=H12-H10$$

where WP is input work 120.

The efficiency of stain augmented power cycle 600 can be describe by the ratio of the total work produced divided by the input energy. The total work produced is the output work 200 minus the input work 120. The input energy is input thermal energy 100. Using the expressions for WT, WP and Q40 the efficiency is described as $$\eta s = \frac{WT - WP}{Q40}$$

where ηs is the efficiency of strain augmented power cycle 600. Substituting the expressions for WT, WP, and Q40 in the expression for ηs results in $$\eta s = \frac{(H14 - H16) - (H12 - H10) + S}{H14 - H12 + S}$$

Using the expressions that describe Q60 and Q40, the waste thermal energy ratio for strain augmented power cycle is described below as $$\omega s = \frac{Q60}{Q40}$$

where ωs is the ratio of waste thermal energy. Substituting the expressions for Q60 and Q40 in the following expression for ηs.

$$\omega s = \frac{H16 - H10}{H14 - H12 + S}$$

In a closed power cycle including strain energy device 600 and prior art Rankine cycle 500, the sum of total work produced plus the waste thermal energy is equal to the total energy expelled from these cycles. The total energy expelled from the system is also equal to the total energy flow into the cycles. This means the sum of the efficiency and the waste thermal energy ratio is equal to one.

For strain augmented power cycle 600 that has the same high temperature and pressure vapor 14 and the same saturated vapor 16 working fluid states as that of prior art Rankine cycle 500, the temperature vs entropy diagram shown in FIG. 1B applies to both cycles. This means the same thermodynamic limitations apply to the strain augmented power cycle 600 and to prior art Rankine cycle 500.

As a result, a direct comparison can be made between the efficiencies of the two cycles. The efficiency of prior art Rankine cycle 500 can be described below as $$\eta r = \frac{(H14 - H16) - (H12 - H10)}{H14 - H12}$$

where ηr is the efficiency of prior art Rankine cycle. The waste energy ratio of prior art Rankine cycle 500 can be described below as $$\omega r = \frac{H16 - H10}{H14 - H12}$$

where ωr is the waste heat ratio for prior art Rankine cycle.

Because the denominator includes the strain energy term, the waste energy ratio for strain augmented power cycle 600 is smaller than the waste energy ratio for prior art Rankine cycle 500. As a result, the efficiency of strain augmented power cycle 600 is greater than the efficiency of prior art Rankine cycle 500.

Advantages

From the description above, a number of advantages of some embodiments of my strain augmented power cycle become evident:

(a) With the use of a strain energy device constructed of a low elastic modulus elastomeric material, the stain augmented power cycle can be employed in systems that have lower temperature and pressure input energy heat sources. Compared to prior art Rankine power cycles, the efficiencies of systems with strain energy devices are greater than what is possible with prior art power cycles that have the same input energy heat sources.

(b) With the use of a strain energy device constructed of an elastomeric material, the strain augmented power cycle can be employed in systems that have equivalent temperature and pressure inputs of prior art Rankine power cycles, with efficiencies that are greater than is possible with prior art power cycles.

(c) With the use of a strain energy device constructed of a compatible material, high temperature and pressure working fluids can come in direct contact with the strain energy device.

(d) The strain energy device can embody a cylindrical geometry.

(e) The strain energy device can embody a spherical geometry.

(f) For working fluid temperatures and pressures that are not compatible with the elastomeric material of the strain energy device, an intermediate fluid can be used to inflate the strain energy device, wherein the working fluid comes in direct contact with the intermediate fluid.

Conclusions, Ramifications, and Scope of Invention

Accordingly, the reader will see that the strain augmented power cycle can be used increase the thermodynamic efficiency of a power cycle. Thus, this invention can be used to recover a greater portion of the power cycle's input thermal energy and convert that energy into useful work. This increased efficiency results from the strain energy imposed in the elastomeric walls of the strain energy device. In the elastomeric walls, strain is substantially reversible and can be recovered as useful work in an expander. Furthermore, the strain augmented power cycle has the additional advantages in that:

It can be employed in the low temperature and pressure heat sources of alternate energy source including but not limited to geothermal, solar thermal and biomass energy sources.

It can be employed where the exhaust heat from an internal combustion engine is the input energy source.

It can be employed using heat sources from the combustion of fossil fuels including but not limited to coal and natural gas.

It can be employed where the energy source is nuclear fusion energy.

Although the description above contains many specificities these should not be construed as limiting the scope of the invention but merely providing illustrations of some of the presently preferred embodiments of this invention. For example, the strain energy device could be used in additional power cycles that include but not limited to: an Ericsson cycle, a Sterling cycle, a Brayton cycle, an Otto cycle, and a Diesel cycle. Thus the scope of the invention should be determined by the appended claims and their legal equivalents, rather than by the examples given.

I claim:

1. A system for generating power from heat, the system comprising:

A. a working fluid;

a condenser in receiving communication with said working fluid,

C. a pump in receiving communication with said working fluid from said condenser;

D. a source of heat energy;

E. an evaporator (i) in working fluid receiving communication with said pump and (ii) in receiving communication with said source of heat energy;

F. one or more strain energy device(s) with each said strain energy device comprising an inlet valve, an exit valve, one or more elastomeric wall(s) that enclose a cavity (i) each said inlet valve of one or more said strain energy device(s) is in working fluid receiving communication with said evaporator;

G. an expander comprising (i) an inlet valve in working fluid receiving communication with at least one of said exit valve(s) of one or more said strain energy device (s), (ii) a working fluid expansion device and (iii) a working fluid outlet in working fluid sending communication with working fluid inlet of said condenser;

wherein said system for generating power from heat is configured to:

a. cool said working fluid from a saturated vapor working fluid to a saturated liquid working fluid in said condenser;

b. pressurize said saturated liquid working fluid to a compressed liquid working fluid in said pump;

c. heat said compressed liquid working fluid to a high temperature and pressure vapor working fluid via said evaporator utilizing said source of heat energy;

d. charge said cavity of said one or more strain energy device(s), wherein said charging causes the cavity to expand from a first position to a second position and imposes strain energy in said one or more elastomeric wall(s), of said one or more strain energy device(s) with said high temperature and pressure vapor through said inlet valve, while said exit valve is in a closed position;

e. discharge said high temperature and pressure vapor from said cavity, wherein said discharging causes the cavity to contract from said second position to said first position and causes said strain energy contained in said elastomeric walls to be transferred to said high temperature and pressure vapor, through said exit valve of said one or more strain energy device(s) into said inlet valve of said expander;

f. expand said high temperature and pressure vapor working fluid to said saturated vapor working fluid in said expander to generate power at said working fluid expansion device;

g. cool said saturated vapor working fluid to said saturated liquid working fluid in said working fluid condenser.

2. The system of claim 1 wherein said one or more strain energy device(s) comprised of said one or more elastomeric wall(s) that encloses an expandable cavity that is substantially cylindrically shaped.

3. The system of claim 1 wherein said one or more strain energy device(s) comprised of said one or more elastomeric wall(s) encloses an expandable cavity that is substantially spherically shaped.

4. The system of claim 1 wherein said high temperature and pressure vapor is expanded to a mixture of saturated liquid and saturated vapor in said expander.

5. The system of claim 1 wherein a liquid transfer fluid is contained within said working fluid cavity(s) wherein the high temperature and pressure vapor working fluid causes the cavity(s) of said one or more strain energy device(s) to be charged by said liquid transfer fluid.

6. A method for generating power from heat, said method with:

A. a working fluid;

B. a condenser;

C. a pump receiving communication with said working fluid from said condenser;

D. a source of heat energy;

E. an evaporator (i) in working fluid receiving communication with said pump and (ii) in heat energy receiving communication with said source of heat energy;

F. one or more strain energy device(s) with each said strain energy device with a working fluid inlet valve, a working fluid exit valve, one or more elastomeric wall(s) that encloses an cavity (i) each said working fluid inlet valve of one or more said strain energy device(s) in working fluid receiving communication with said evaporator;

G. each said working fluid inlet valve of one or more said strain energy device(s) in working fluid receiving communication with said working fluid evaporator;

H. an expander with (i) a working fluid inlet in working fluid receiving communication with at least one of said exit valve(s) of one or more said strain energy device (s), (ii) a working fluid expansion device and (iii) a working fluid outlet in working fluid sending communication with working fluid inlet of said working fluid condenser;

wherein said method for generating power from heat:

a. cools said working fluid from a saturated vapor working fluid to a saturated liquid working fluid in said condenser;

b. pressurizes said saturate liquid working fluid to a compressed liquid working fluid in said pump;

c. heats said compressed liquid working fluid to a high temperature and pressure vapor via said evaporator utilizing said source of heat energy;

d. charges said cavity, wherein said charging causes the cavity to expand from a first position to a second position and imposes strain energy in said one or more elastomeric wall(s), of said one or more strain energy device(s) with said high temperature and pressure vapor through said one or more inlet valve while said exit valves is in a closed position;

c. discharges said high temperature and pressure vapor from expandable working fluid cavity, wherein said discharging causes the cavity to contract from said second position to said first position and causes said strain energy contained in said one or more elastomeric wall(s) to be transferred to said high temperature and pressure vapor, through said exit valve of said one or more strain energy device(s) into said working fluid inlet of said working fluid expander;

d. expands said high temperature and pressure vapor to said saturated vapor working fluid in said expander;

n. e. cool said saturated vapor working fluid to said saturated liquid working fluid in said condenser.

7. The method of claim 6 wherein said one or more strain energy devices comprised of said elastomeric wall encloses an expandable cavity that is substantially cylindrically shaped.

8. The method of claim 6 wherein said one or more strain energy devices comprised of said elastomeric wall encloses an expandable cavity that is substantially spherically shaped.

9. The method of claim 6 wherein said high temperature and pressure vapor is expanded to a mixture of saturated liquid and saturated vapor in said expander.

10. The method of claim 6 wherein a liquid transfer fluid is contained within said working fluid cavity(s) wherein the high temperature and pressure vapor working fluid causes the cavity(s) of said one or more strain energy device(s) to be charged by said liquid transfer fluid.

* * * * *